US007134781B2

(12) United States Patent
Roberts et al.

(10) Patent No.: US 7,134,781 B2
(45) Date of Patent: Nov. 14, 2006

(54) SELF-MIXING TANK

(75) Inventors: Benjamin R. Roberts, Los Altos, CA (US); Peter M. Pozniak, San Jose, CA (US)

(73) Assignee: The BOC Group, Inc., Murray Hill, NJ (US)

( * ) Notice: Subject to any disclaimer, the term of this patent is extended or adjusted under 35 U.S.C. 154(b) by 185 days.

(21) Appl. No.: 10/364,809

(22) Filed: Feb. 11, 2003

(65) Prior Publication Data

US 2004/0156262 A1 Aug. 12, 2004

(51) Int. Cl.
*B01F 15/02* (2006.01)

(52) U.S. Cl. ..... 366/137; 366/167.1

(58) Field of Classification Search ..... 366/136–137, 366/159.1, 167.1, 173.1, 173.2; 137/563
See application file for complete search history.

(56) References Cited

U.S. PATENT DOCUMENTS

| | | | | |
|---|---|---|---|---|
| 2,603,460 | A | * | 7/1952 | Kalinske |
| 2,906,607 | A | * | 9/1959 | Jamison |
| 3,647,357 | A | | 3/1972 | Niedner et al. |
| RE27,681 | E | * | 6/1973 | Gaddis |
| 3,762,689 | A | | 10/1973 | Hege |
| 4,534,655 | A | * | 8/1985 | King et al. |
| 4,812,045 | A | * | 3/1989 | Rivers |
| 5,332,312 | A | * | 7/1994 | Evanson |
| 5,564,825 | A | * | 10/1996 | Burt |
| 5,769,536 | A | * | 6/1998 | Kotylak |
| 6,065,860 | A | * | 5/2000 | Fuchsbichler |
| 6,186,657 | B1 | * | 2/2001 | Fuchsbichler |

FOREIGN PATENT DOCUMENTS

| | | | |
|---|---|---|---|
| DE | 2151205 | * | 4/1973 |
| DE | 20000841 U1 | * | 5/2000 |
| JP | 9-33000 | * | 2/1997 |

OTHER PUBLICATIONS

Declaration of Michael Miano.
International Search Report consisting of Notification Concerning Transmittal of Copy of International Preliminary Report on Patentability, International Preliminary Report on Patentability, and Written Opinion of the International Searching Authority (7 pages total).

* cited by examiner

*Primary Examiner*—Charles E. Cooley
(74) *Attorney, Agent, or Firm*—David A. Hey; Ira L. Zebrak

(57) ABSTRACT

A tank comprising a rounded bottom section with an inlet located at the lowest point of the rounded bottom section having openings to direct fluid against the curved side walls to form a circulation cell. An outlet is provided inside the tank located above and in close proximity to the inlet. The design of the tank, inlet and outlet provide a circulation pattern that can mix, maintain and resuspend fluids and slurries.

23 Claims, 13 Drawing Sheets

SELF-MIXING TANK

FIELD OF THE INVENTION

This invention relates to the general field of slurry handling and more particularly, to providing non-mechanical agitation to a fluid in a tank.

BACKGROUND OF THE INVENTION

Some industrial liquids require constant agitation for rheological or processing reasons. Typically, such fluids are dilatant or thixotropic in nature.

Additionally, slurries consisting of small solid particles suspended in a liquid medium typically require some level of agitation in order to keep the solids from settling. Often in industrial processes slurries are stored and mixed in tanks with a mechanical agitator such as a propeller. Circulation pumps then move the slurries from the tanks through distribution piping loops that deliver the slurries to points of use with unused slurry returning to the storage or day tanks.

This invention eliminates the need for mechanical agitators in tanks for many industrial processes. Eliminating the mechanical agitator reduces capital equipment, operation and maintenance costs and the potential for the mechanical agitator to fail and contaminate the fluid. In addition, some fluids are shear sensitive and can be damaged by mechanical agitation.

Rotating mechanical equipment (like mechanical agitators) tend to be rather "dirty" devices producing a continuous shower of wear by-products. This shower of particles poses a threat of contamination particularly in the pharmaceutical and semiconductor industries.

Others have utilized high purity gas bubbling through slurry tanks as a way to eliminate mechanical agitators. Gas bubble agitation has its drawbacks including the cost of a high purity gas, disposal of the spent gas, gas entrainment in the slurry, plugging of the gas spargers/septa, reduced energy efficiency and ineffectiveness at maintaining all but slow settling solids in suspension.

Thus, there still remains a need for a reliable, clean and relatively low shear means to mix industrial fluids in tanks.

BRIEF SUMMARY OF THE INVENTION

This invention provides that a specially shaped tank induces mixing without the need for mechanical agitators. By properly controlling the tank's inlet and outlet structures, gentle-mixing currents develop ensuring adequate agitation to maintain fluids in motion and to maintain slurry suspensions.

The invention consists of a round-bottomed tank having an inlet and an outlet, which together induce deterministic circulation patterns that provide for gentle, effective mixing of the tank contents.

In one preferred embodiment, the invention is a tank comprising a top section, a rounded bottom section, an inlet and an outlet. The top section comprises a front wall, an opposing back wall, and two mutually opposing side walls defining a rectangular cross-section having a width side-to-side and a width front-to-back such that the front-to-back width is less than the side-to-side width. The rounded bottom section comprising a lowest point has at least one curved wall extending from the lowest point to at least one side wall of the top section. The inlet is located on the rounded bottom of the tank at the lowest point of the rounded-bottom section. Extending from the inlet to the inside of the tank is a rigid pipe that contains at least two holes that direct fluid toward the front-to-back width walls. The outlet is located inside the tank above and in close proximity to the inlet.

BRIEF DESCRIPTION OF THE DRAWINGS

Preferred embodiments of the invention are described below with reference to the following accompanying drawings, which are for illustrative purposes only. Throughout the following views, reference numerals will be used in the drawings, and the same reference numerals will be used throughout the several views and in the description to indicate same or like parts.

FIG. 1 F shows a front view of one section of the tank.

DETAILED DESCRIPTION OF THE INVENTION

In the following detailed description, references made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural changes may be made without departing from the spirit and scope of the present invention.

Figure 1A:
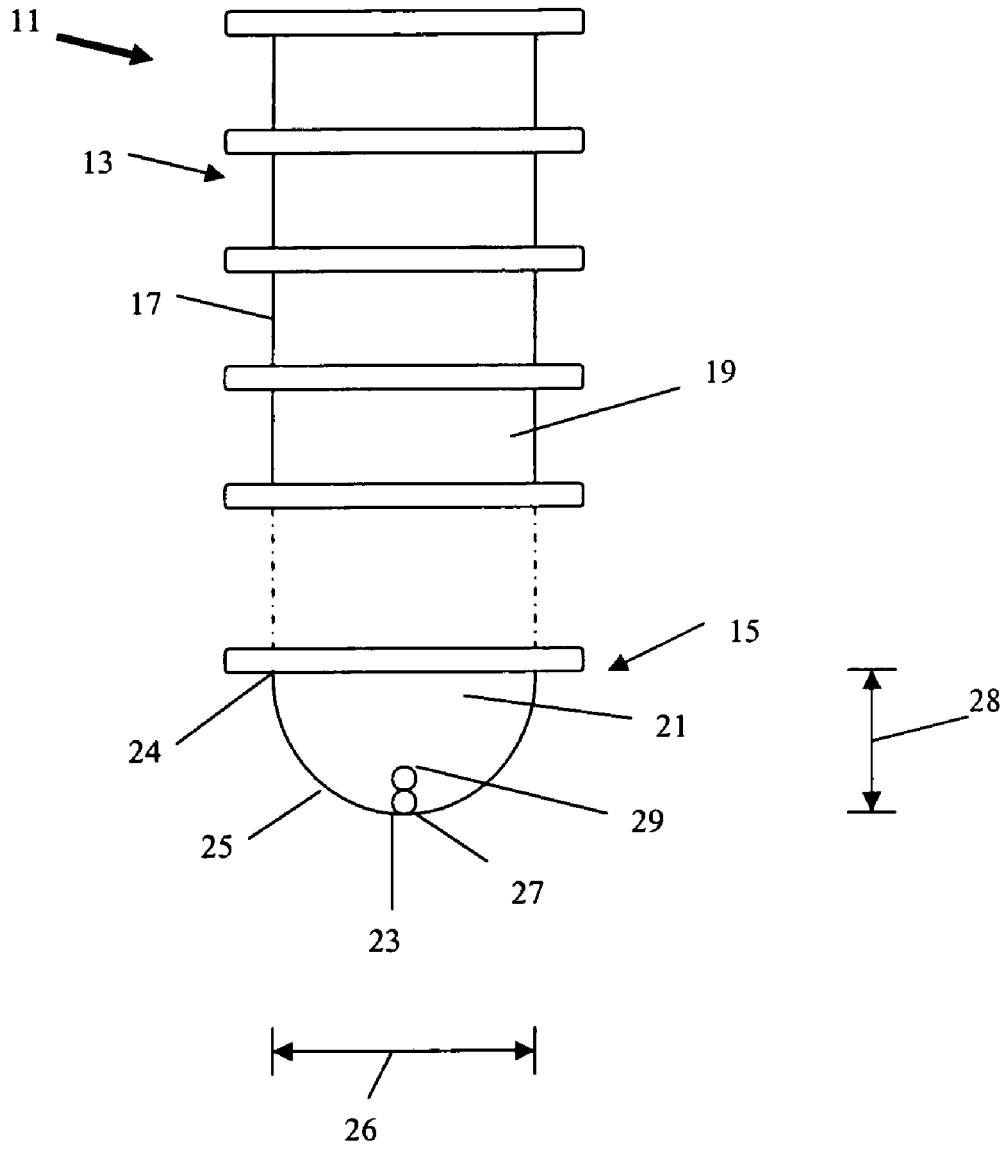
FIG. 1A is a partially expanded front view of the tank.

FIG. 1A shows a partially expanded front view of the inventive tank 11. Tank 11 has a top section 13 and a bottom section 15, which in this view is shown detached. Top section 13 is attached to bottom section 15, either permanently or detachably. Top section 13 may be comprised of subsections 17 for ease of construction. Furthermore, top section 13 has a fundamentally rectangular front profile 19. The term "fundamentally rectangular" is used to indicate that the profile has the general overall shape of a rectangle but may have slight deviations from the rectangular shape as long as such deviations do not significantly impede the formation of circulation cells (as described below). Such deviations include, but are not limited to, rounded corners or tapering of the rectangle sides. One embodiment of the present invention is shown in FIG. 1F, wherein the from profile 19 is square.

Bottom section 15 has a rounded front profile 21 thereby defining a curved side wall. Any rounded profile 21 having a single lowest point 23 and forming at least one concave curved side wall 25 extending from lowest point 23 to a transition point 24 where the top and bottom sections are attached to each other may be used for the inventive tank. In a preferred embodiment, this rounded profile 21 is designed to approximate the geometry of two, side-by-side circulation cells, also known as eddies. In such an embodiment, the rounded profile 21 should be designed so that the ratio of the width 26 of the rounded-bottom to the depth 28 of the rounded-bottom is approximately two to one (2:1). Attached to the front profile 21 at the lowest point 23 is an inlet 27. In a preferred embodiment, inlet 27 comprises a pipe or other like device extending across the tank from a bulkhead on either the front or back wall.

Figure 2A:
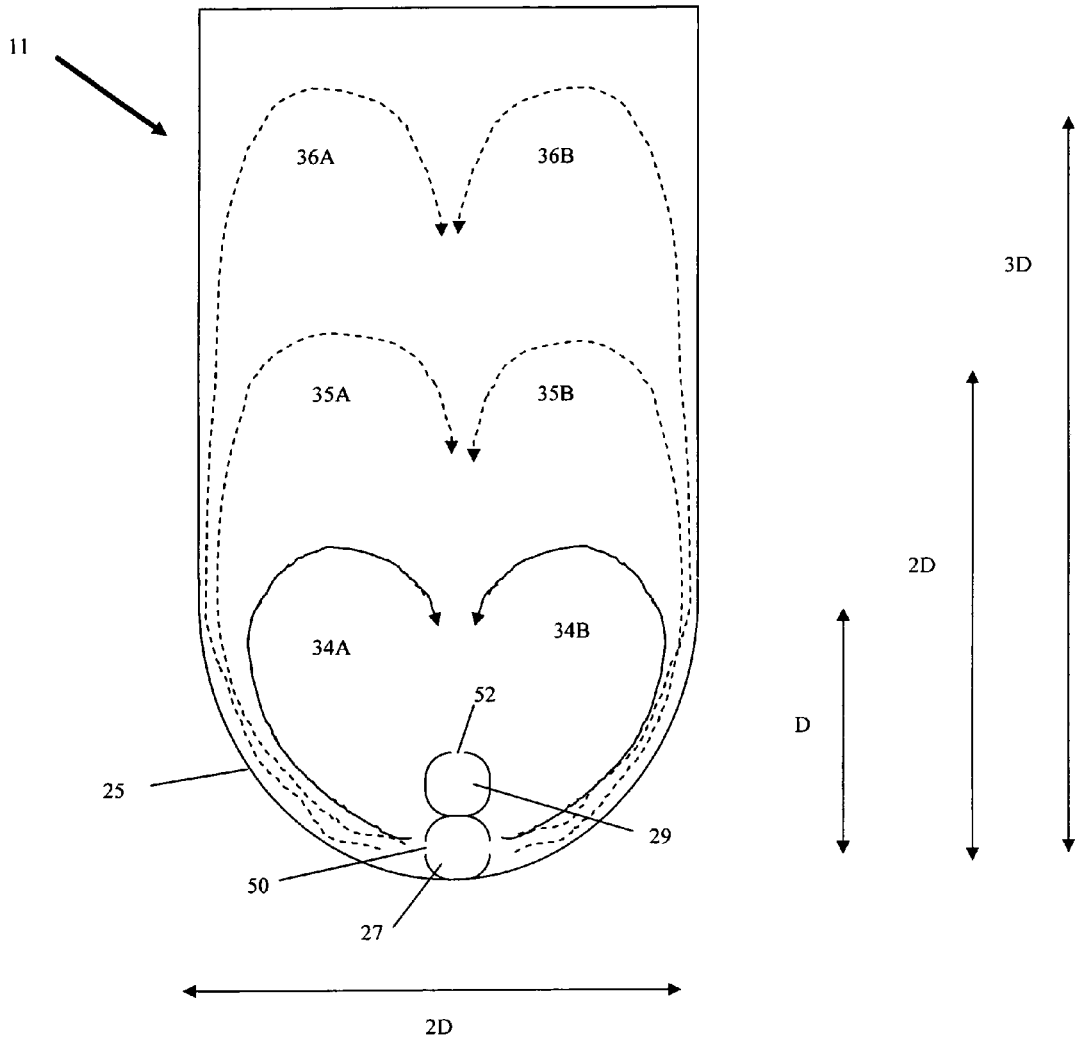
FIG. 2A is a schematic front view showing an embodiment of the inlet and outlet.

As shown in FIG. 2A, in one preferred embodiment, inlet 27 has opposing lines of holes or slits 50, preferably at least one hole or slit per side. A pair of openings in inlet 27 located at the mid-point between the front and back walls did not perform as well as multiple pairs of openings. The opposing line of holes or slits 50 are machined into inlet 27 directed toward the curved side wall 25. The openings in inlet 27 produce jets when a fluid is pumped through them. The diameter of the openings can be adjusted based upon the fluid properties. For viscous or shear sensitive fluids, the diameter would be relatively large. For fast-settling fluids that are not shear sensitive, the diameter of the openings should be relatively small to increase the velocity of the fluid in the jets.

Figure 2B:
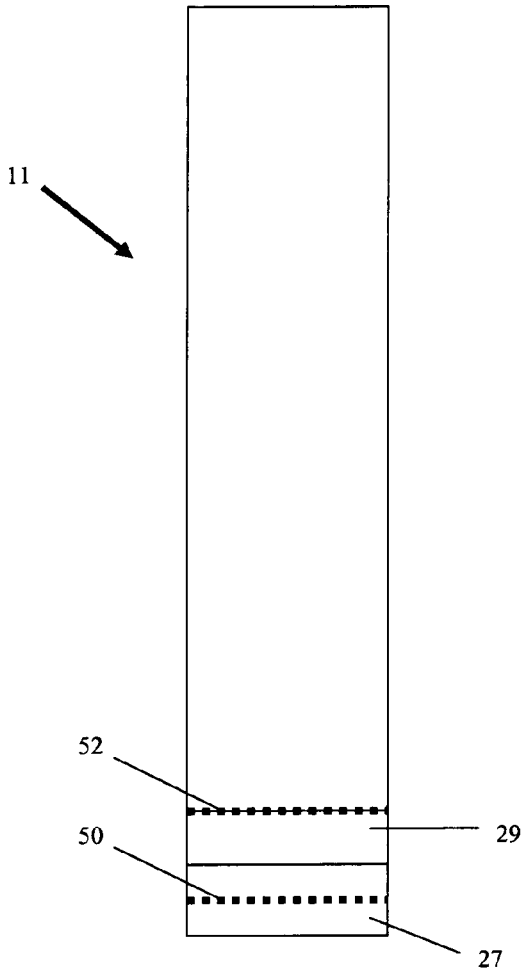
FIG. 2B is a schematic side view showing a further embodiment of the inlet and outlet.
Figure 2C:
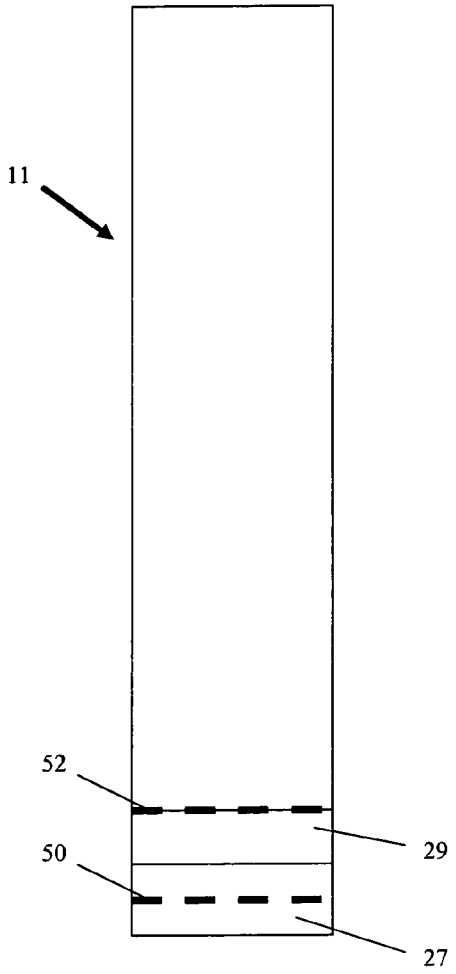
FIG. 2C is a schematic side view showing another embodiment of the inlet and outlet.

Outlet 29 is located on tank 11 above inlet 27. Outlet 29 comprises a pipe or other like device. In a preferred embodiment, outlet 29 extends across the tank from a bulkhead on either the front or back wall. Outlet 29 has at least one hole or slit 52 Typically, outlet 29 has a single line of holes or slits 52 on the pipe, or like device, facing vertically upward. The number and size of these holes or slits 52 are designed to maximize the circulation pattern in the tank. FIG. 2A shows one embodiment of the present invention, showing holes 50 in inlet 27 and holes 52 in outlet 29. FIG. 2C shows a further embodiment of the present invention, showing slits 50 in inlet 27 and slits 52 in outlet 29.

Figure 1B:
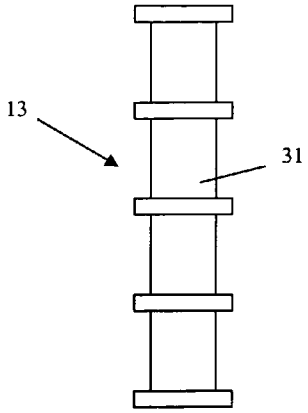
FIG. 1B is a side view of the top portion of the tank.

FIG. 1B shows a side view of top section 13, illustrating the rectangular side profile 31.

Figure 1C:
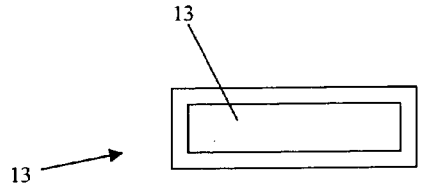
FIG. 1C is an overhead view of the tank.

FIG. 1C shows an overhead view of top section 13 illustrating the rectangular cross section profile 33.

Figure 1D:
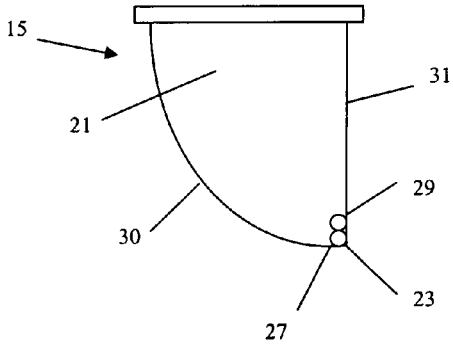
FIGS. 1D and 1E each show alternative embodiments of the bottom section of the tank.

FIG. 1D shows an alternative front profile 21 for the bottom section 15. The alternative profile of bottom section 15 is half of a semi-circle. Inlet 27 is again located at lowest point 23 with outlet 29 located above inlet 27. Inlet 27 has at least one hole or slit directed toward curved portion 30 of the rounded bottom shown in FIG. 1D. In this embodiment, there is typically not an opposing hole or slit directed toward straight portion 31 of the rounded bottom. Outlet 29 is constructed as described above, with at least one hole or slit that is orientated to the top of the tank (shown in FIG. 2).

Figure 1E:
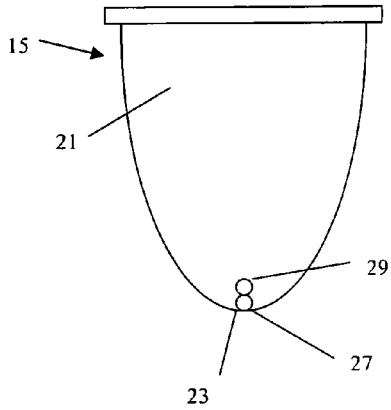
Figure 1F:
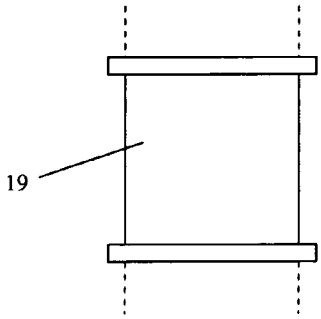
FIG. 1 A–C shows a tank usable for this invention.
FIG. 1G shows a partial front view of the tank.
FIG. 1H shows a partial side view of the tank.

FIG. 1E shows another alternative for bottom section 15 having a parabolic front profile 21. The inlet 27 is located at the lowest point 23 of the parabolic front profile 21. Again, the outlet 29 is located directly above the inlet 27.

Figure 1G:
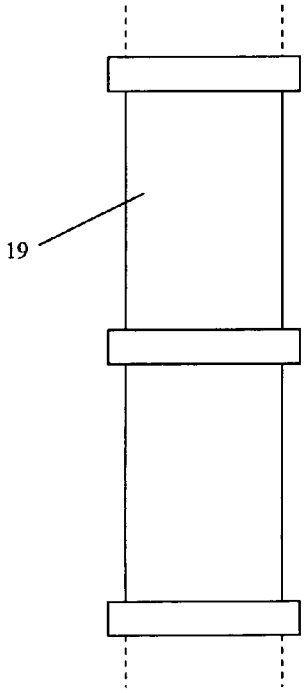
Figure 1H:
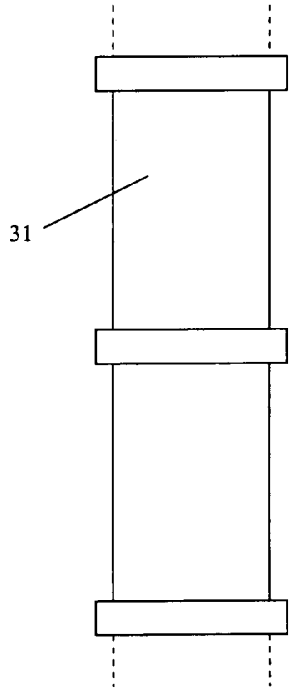

FIGS. 1G and 1H show partial front and side views respectively, wherein profile 19 and profile 33 are of equal width.

In a preferred embodiment of the invention, inlet 27 is located at the lowest point 23 of bottom section 15 to generate the circulation cells with the highest velocity. As the height of the tank increases by a factor of depth D of the rounded bottom shown in FIG. 1, another row of circulation cells will form as shown in FIG. 2A. Therefore, when the height of the tank is 2D, there will be two sets of circulation cells 34A, 34B and 35A, 35B. Similarly, when the height of the tank is 3D, there will be three sets of circulation cells 34 A, 34B; 35A, 35B and 36A, 36B. As the height of the tank increases, each additional set of circulation cells has less velocity than the lower row. The outlet 29 is located directly above and in close proximity to inlet 27. This location of inlet 27 and outlet 29 provides for a low pressure suction area located at the natural return point of the circulation pattern formed by the fluid jets. Each of openings 50 in inlet 27 form substantially planar circulation cells. The use of multiple openings 50 thereby creates a series of parallel substantially planar circulation cells. As such, the tank provides a 2-dimensional flow pattern within a 3-dimensional tank. Therefore, the distance between the front and back walls is not critical.

Figure 3:
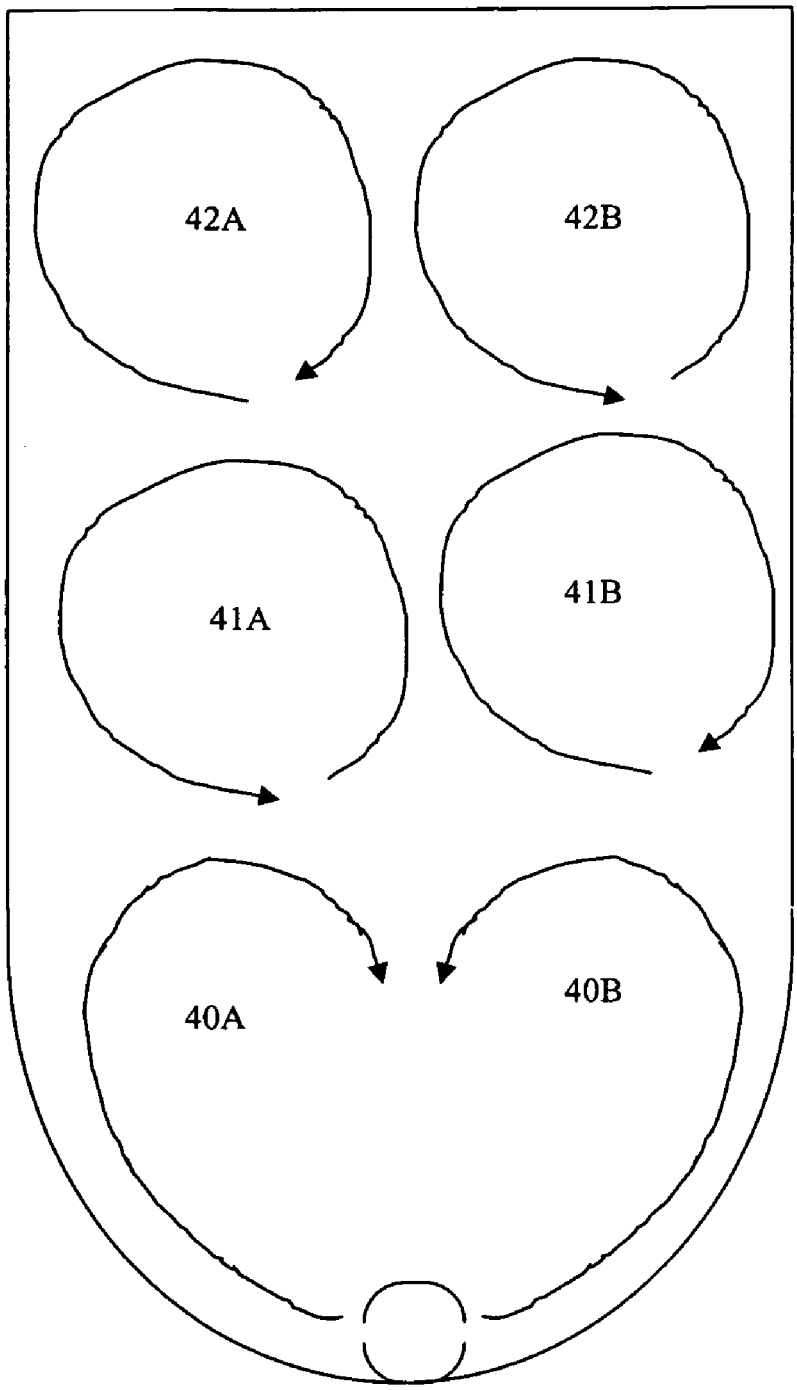
FIG. 3 is a schematic front view demonstrating comparative counter-rotating circulation cells.

Referring to FIG. 3, when multiple pairs of circulation cells form (40A and B, 41A and B, 42A and B, etc.), each individual cell should rotate in the opposite direction to any adjacent circulation cell based upon fluid mechanics theory as shown by the direction of the arrows depicted in FIG. 3. This opposed direction of rotation of adjacent cells is due to viscous interaction between adjacent cells which causes the fluid at the boundary of each adjacent cell to flow in the same direction.

However, in the inventive self-mixing tank, all circulation cells on the same side of the tank 34A, 35A, 36A and 34B, 35B, 36B have been observed to unexpectedly rotate in the same direction as shown by the direction of the arrows depicted in FIG. 2A. The unexpected rotation pattern of adjacent cells is believed to be due to the present invention. First, the curvature of rounded bottom section 15 results in the relatively strong jets formed by inlet 27 being directed upward in a path generally parallel to the inside surface of the side wall of top section 13. Based upon observation and testing, some of the flow of the jets persists along the side wall thereby imposing a similar flow pattern for each cell on that side. Additionally, outlet 29 is located such that a low-pressure area is created in the center of the tank, which creates an overall downward flow in the middle of the tank. This downward flow overcomes the circulation cells that flow from the center to the side walls.

Figure 4:
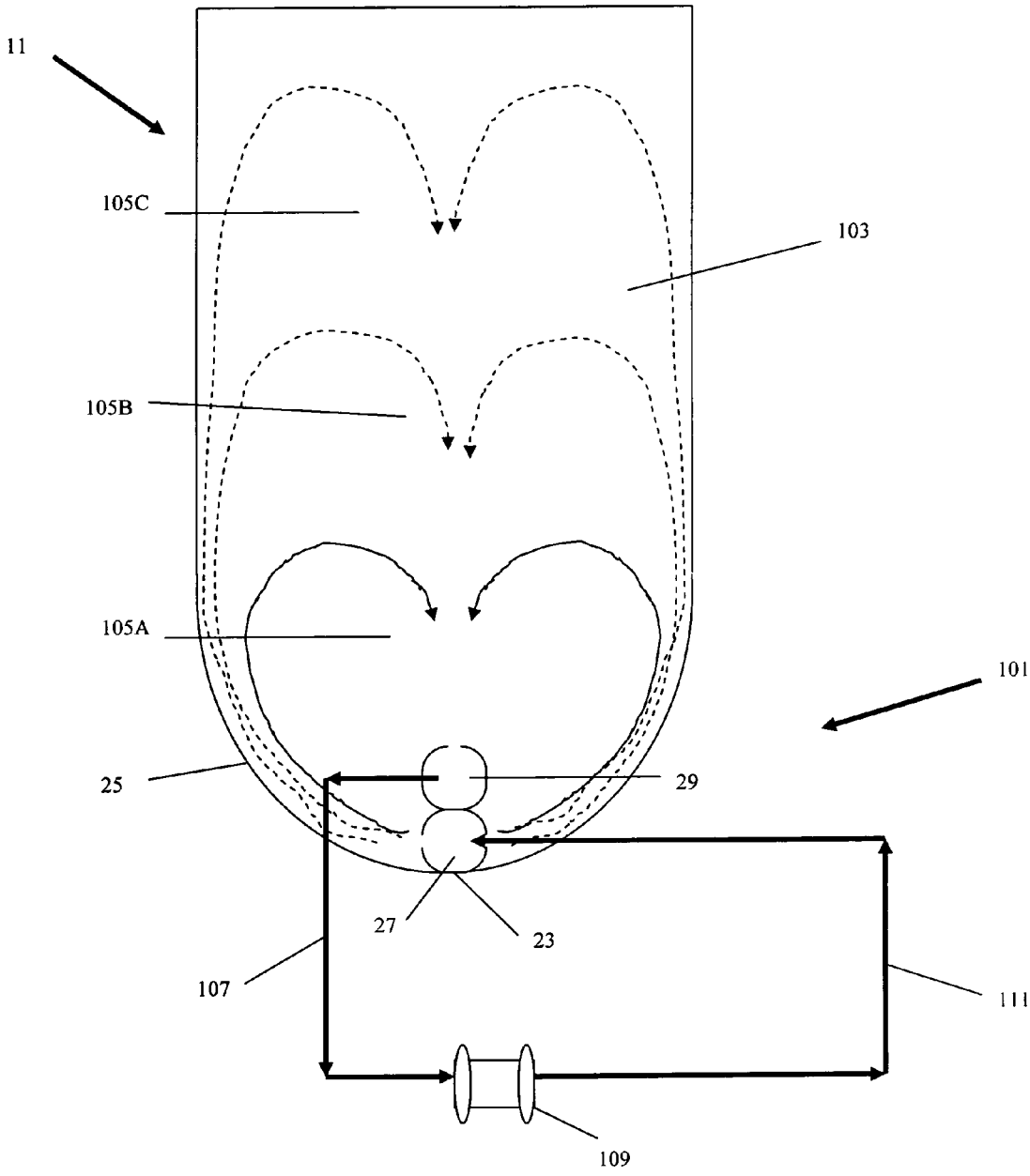
FIG. 4 is a schematic view demonstrating use of the tank as a self-agitating hold tank.

FIG. 4 shows a schematic view of inventive tank 11 used in recirculation system 101 to store and distribute fluid 103 such as a slurry. Tank 11 has, in this case, a full radius round bottom with lowest point 23. Inlet 27 is located at lowest point 23 and is a pipe extending into the tank. Openings (not shown) in inlet 27 provide for fluid jets directed towards curved side wall 25. Preferably, the openings consist of at least one pair of opposing slits or holes thereby forming fluid jets. A single set of holes or slits, in inlet 27 has been found to be less effective than multiple pairs of openings. The fluid jets exiting inlet 27 form circulation cells 105A, 105B and 105C which proceeds upwards along the sides of tank 11 developing the desired circulation cells. Circulation cells 105A, 105B and 105C naturally return to a point near their origination point (i.e., inlet 27). Outlet 29 is located such that a low-pressure area is created in the center of the tank, which creates an overall downward flow in the middle of the tank. As explained above, this downward flow overcomes the circulation cells that flow from the center to the side walls. Outlet 29 feeds outlet pipe 107, which is in fluid communication with recirculation pump 109. Recirculation pump 109 would be standard equipment for a slurry handling system because the slurry must be maintained in constant motion through the slurry recirculation-distribution loop.

Recirculation pump 109 pumps fluid 103 through recirculation-distribution loop 111 which eventually feeds inlet 27 and thereby forms the jets.

Figure 5:
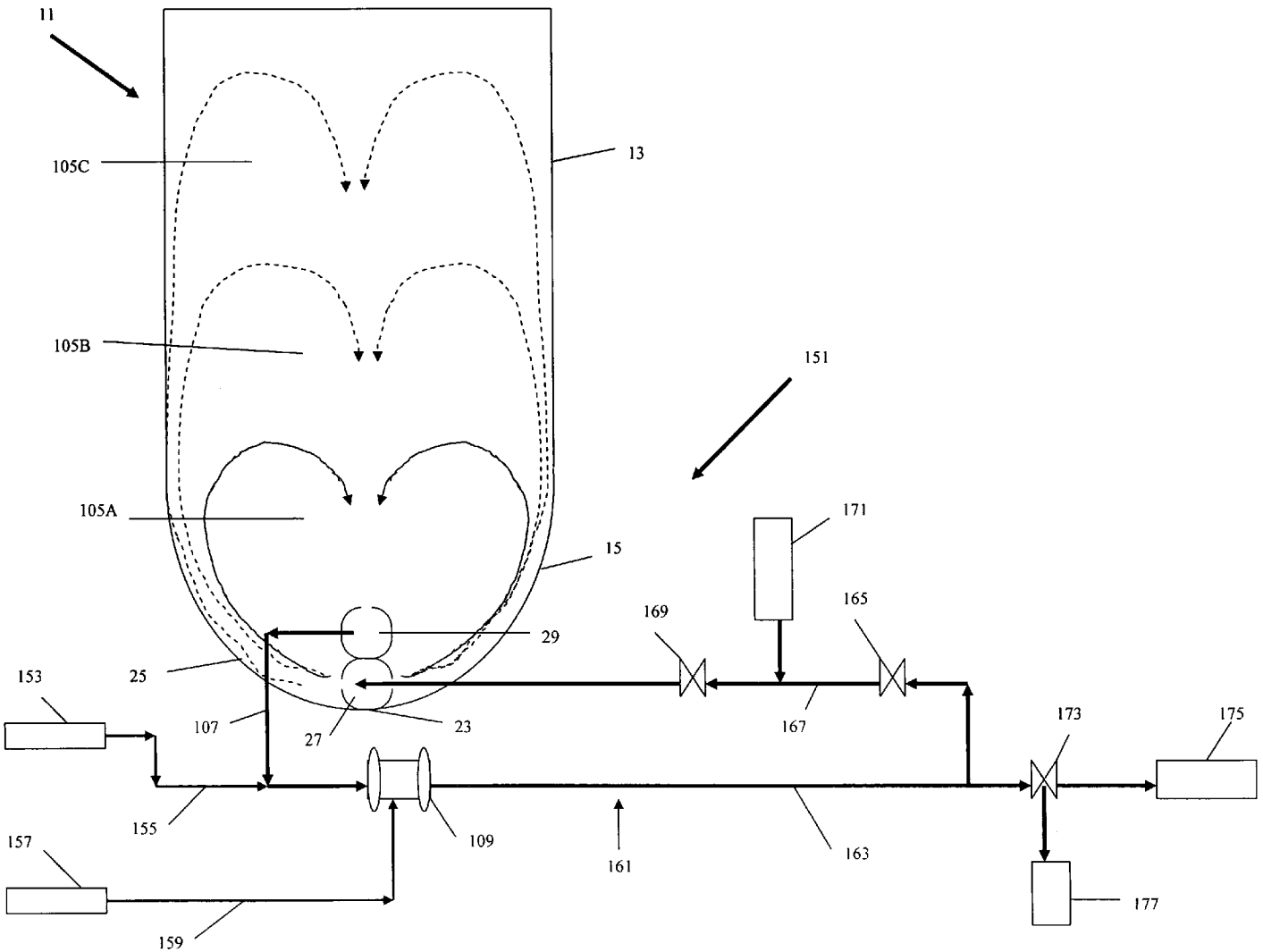
FIG. 5 shows the inventive tank used as a combination hold and mixing tank.

FIG. 5 shows tank 11 used in system 151 to provide a combination of mixing and storage. Tank 11 has curved bottom section 15 (as shown here a full radius semi-circle) having lowest point 23. Inlet 27 is located on the side of tank 11 at lowest point 23. Inlet 27 has at least one set of at least two opposed openings to produce fluid jets directed towards curved side wall(s) 25. The fluid jets produce circulation cells 105A, 105B and 105C which flows up around curved side wall 25 up through top section 13 of the tank, until it returns to a point proximate to the origination point of inlet 27. Outlet 29 is located near the natural termination point of circulation cells 105A, 105B and 105C and thereby creates a low pressure area to promote the formation of the circulation cells 105A, 105B and 105C. Outlet 29 is connected to recirculation pump 109 via outlet pipe 107. Also connected to the inlet side of recirculation pump 109 is a source of make up fluid 153, such as deionized water, which is in fluid communication with pump 109 through piping system 155. The pump may also be connected via delivery line 159 to air source 157, if the pump is air powered. Recirculation pump 109 pumps fluid 103 through piping system 161 which may be a slurry distribution loop. Fluid flow from piping system 161 may subsequently be split. One portion flows through mixing loop 163 which is rate controlled by metering valve 165. Fluid flow passing through control valve 165 passes through a larger diameter piping system 167 before reaching second control valve 169. The material to be mixed, such as a dye injection, is introduced from source 171 into injection piping system 167. Fluid passing through control valve 169 reenters recirculation system 161 and flows to inlet 27 of tank 11.

A primary route for fluid 103 is to pass through recirculation system 161 to piping system 163 and then to inlet 27 of tank 11. Flow from piping system 163 may also flow through valve 173 to drain 175 or to distribution loop 177.

The inventive tank may be used with most industrial liquids requiring efficient mixing or needing constant circulation. As explained above, the diameter of the openings can be adjusted based upon the liquid properties. For viscous or shear sensitive liquids, the diameter would be relatively large. For fast-settling liquids that are not shear sensitive, the diameter of the openings should be relatively small to increase the velocity of the liquid in the jets. As such, the inventive tank is well adapted to use in a slurry handling system. The inventive tank is capable of handling slurries that have settling times in the range of minutes to hours. The inventive tank may not be able to maintain suspension of slurries that settle out in seconds, e.g., coarse sand and water.

Although the inventive tank is suitable for most applications and industries, certain high viscosity, sensitive fluids may not be suitable for use with this tank. For example, high viscosity fluids require increasing the energy imparted by the nozzle jets produced by the inlet in order to form the circulation cell. However, such high energy or shear may damage the fluid.

The turnover rate through the tank depends on the fluid or slurry characteristics. Turn-over rates of 5–10 liters per minute in a 110 liter tank are generally satisfactory. This provides for a turn over time between about 6 to about 20 minutes. Of course, higher or lower turn over times may be used where appropriate for the fluid.

The following examples illustrate the ability of the tank to achieve mixing and maintain particles in suspension. The prototype tank was designed with width 2D and height 3D as shown in FIG. 2A. During testing, a spotlight was located at the top of the tank to aid with visual observations. The tank had a full radius round bottom such that the radius, or depth, was D. A set of circulation cells should form at 1D, 2D and 3D. The effective volume of the tank was 100 liters. For the following examples, the aspect ratio is the ratio of the height of the liquid to the depth of the rounded bottom section (i.e., D).

EXAMPLE 1

Deionized Water and Dye Experiment

In Example 1, deionized (DI) water was circulated through the tank. Green dye was injected into the DI water stream entering the tank in order to determine the general flow patterns. Visual observations indicated that jets were produced in the tank and mixing was achieved quickly. The general flow patterns of the jets were similar to FIG. 2A. A quantitative method was used to determine the time required to achieve homogenization. The time for the first green jet to reach the surface of the water was recorded. The jets, hence the green dye, flowed toward the side of the tank and upwards. The height that the dye reached in the tank depended on the flow rate.

Figure 6:
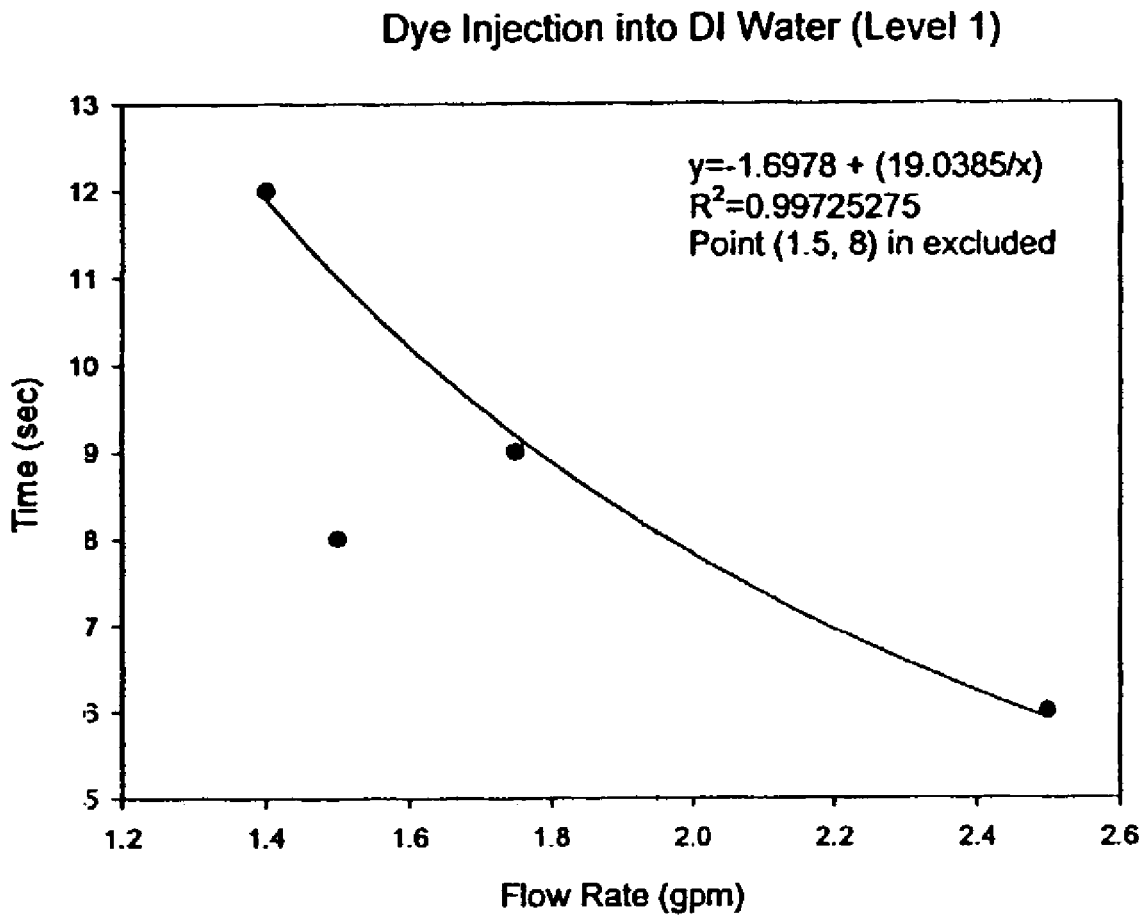
FIG. 6 is a graph showing mixing time as a function of flow rate.

At a height of 1D with an average flow rate of 1.4 gpm (5.3 lpm) the time required for 1 turnover was calculated to be 6.98 minutes. The time required for dye to reach the surface of the liquid was 12 seconds and to homogenize was 1 minute and 10 seconds. Therefore, the color homogenized before 1 turnover. The mixing time when graphed as a function of flow rate resulted in an inverse first order relationship (refer to FIG. 6).

With the tank filled to a height of 3D and operating at a maximum flow rate of 3.8 gpm (14.364 lpm), only 18 seconds was required for the dye to reach the surface of the liquid. Table 1 shows the data collected during the DI and Dye Experiment in Example 1.

TABLE 1

Data Collection Sheet for DI and Dye Experiment

| Height | Liquid Volume | DI Flow Rate (gpm) | Pump Pressure (psi) | Inlet Pressure (psi) | Time required for dye to reach the top of liquid | Homogenization Time |
|---|---|---|---|---|---|---|
| 1D | 37.03 | 1–1.8 | 12 | 0–1 | 12 sec | 1:10 min |
| 1D | 37.03 | 1–2 | 15 | 0–2 | 8 | 50 sec |
| 1D | 37.03 | 1.25–2.25 | 20 | 0–2 | 9 | 57 sec |
| 1D | 37.03 | 2.4–2.6 | 26 | 0–2 | 6 | 32 sec |
| 1D | 37.03 | | | | | |
| 2D | 78.52 | | | | | |
| 2D | 78.52 | | | | | |
| 2D | 78.52 | | | | | |
| 2D | 78.52 | | | | | |
| 3D | 99.27 | 3.8 | | | 18 | |
| 3D | 99.27 | | | | | |
| 3D | 99.27 | | | | | |
| 3D | 99.27 | | | | | |
| 3D | 99.27 | | | | | |

EXAMPLE 2

Addition of Saline Solution to D1 Water

Figure 7:
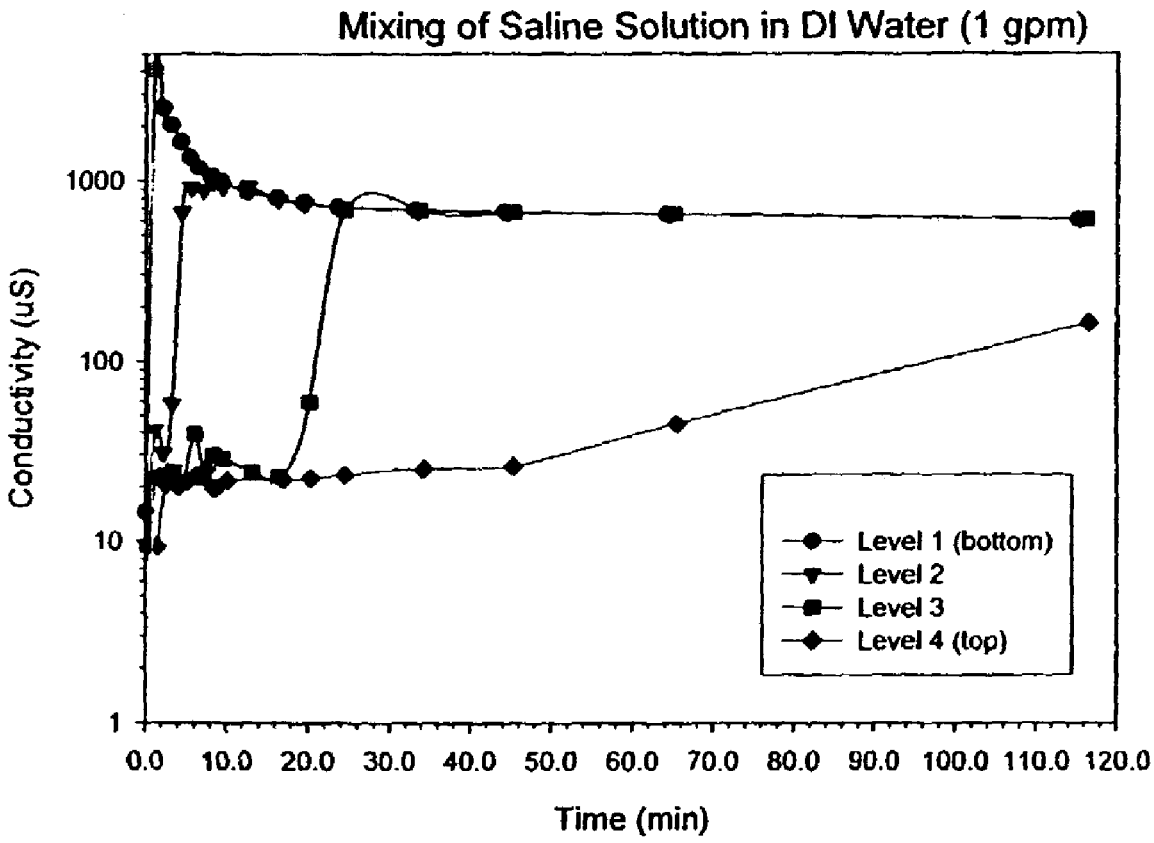
FIG. 7 is a graph showing conductivity as a function of time at a flow rate of 0.9 gal/mm.

The results of the dye test were confirmed by injecting saline solution and dye into the DI water flow. These samples were measured for conductivity. The tank was filled to level 4 which was 99.27 liters and the content was recirculated at an average flow rate of 0.9 gpm. Saline solution with a conductivity of 144.6 mS and concentrated dye were added to the flow entering the tank. Conductivity measurements were performed on samples obtained at 4 points in the tank over time. These four points are: level 1, the inlet; level 2, height of 1D; level 3, height of 2D; and level 4, top of the fluid at a height of 3D. The results of the conductivity measurements are listed in Table 2 and represented in graphical format in FIG. 7. It was found that in approximately 20 minutes levels 1, 2 and 3 homogenized and level 4 began to homogenize after 1 hour. The reason for the lag time in achieving mixing at level 4 was due to density differences between the saline solution and DI water. The density of saline solution is 1.078 g/ml, and the density of DI water is 0.999 g/ml. Due to these density differences, at a flow rate of 0.9 gpm the jets did not have enough energy to reach level 4.

Process Conditions for Example 2

Flow rate=0.9 gal/min=3.41 l/min

Conductivity of original saline solution=144.6 mS

Pressure at Pump=17 psi

Pressure at Inlet=2–2.5 psi 8 shots of the dye was added through an AOV programmed to open for 15 ns and close for 20 ns.

Figure 8:
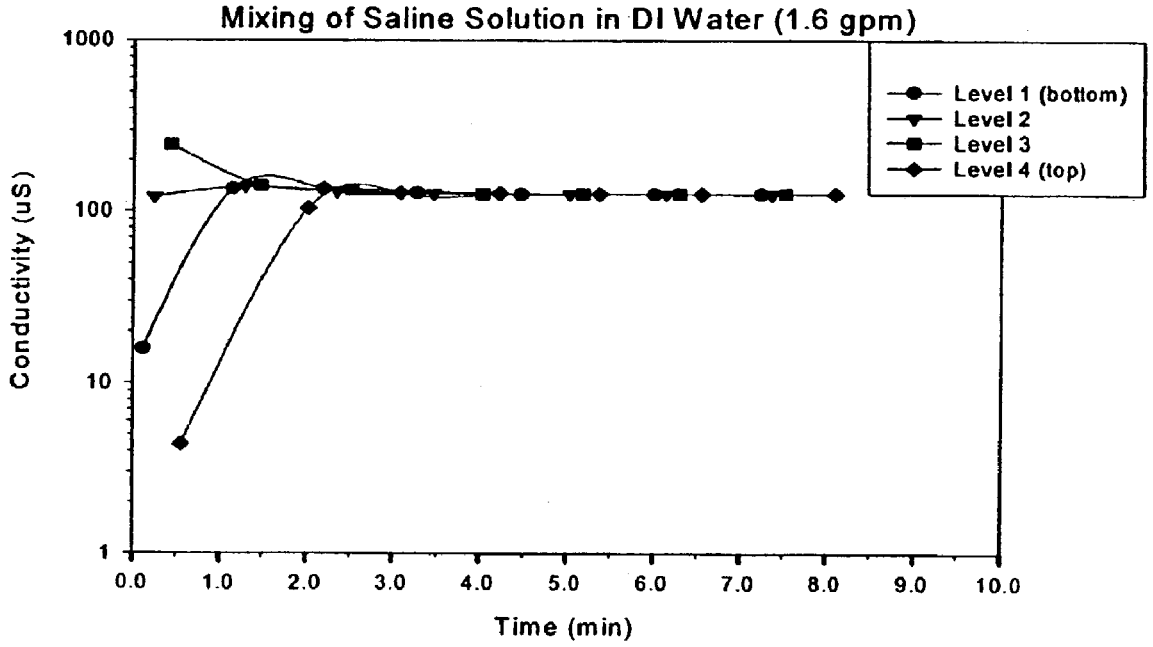
FIG. 8 is a graph showing conductivity versus time at a flow rate of 1.6 gal/mm.

Example 2 was repeated at a higher flow rate so that mixing could be observed up to level 4. An average flow rate of 1.6 gpm was used to recirculate the tank contents. Again saline solution with concentrated dye was injected into the flow entering the tank. Samples were obtained from 4 levels in the tank and evaluated for conductivity as described in Example 2. The results are tabulated in Table 3 and represented in FIG. 8. When operating at a flow rate of 1.6 gpm mixing was achieved at all levels in less than 3 minutes.

Flow rate=1.6 gal/min=6.06 /min

Conductivity of original saline solution=146.8 mS

Pressure at Pump=17 psi

Pressure at Inlet=2.5–4 psi 8 shots of the dye was added. AOV was programmed to open for 15 ns and close for 20 ns.

TABLE 2

Conductivity Results at Flow Rate 0.9 GPM

| Time (min) | Conductivity (μS) Level 1 | Time (min) | Conductivity (μS) Level 2 | Time (min) | Conductivity (μS) Level 3 | Time (min) | Conductivity (μS) Level 4 |
|---|---|---|---|---|---|---|---|
| 0.05 | 14.44 | 0.20 | 9.47 | 0.36 | 9.36 | 0.50 | 9.55 |
| 1.06 | 4073.00 | 1.19 | 41.33 | 1.33 | 22.18 | 1.46 | 9.33 |
| 2.05 | 2535.00 | 2.20 | 30.82 | 2.36 | 23.06 | 2.52 | 20.69 |
| 3.08 | 2043.00 | 3.26 | 58.88 | 3.41 | 24.40 | 4.00 | 20.10 |
| 4.18 | 1635.00 | 4.36 | 667.00 | 4.56 | 20.91 | 5.18 | 21.38 |
| 5.38 | 1337.00 | 5.54 | 914.50 | 6.08 | 39.29 | 6.23 | 23.14 |
| 6.43 | 1180.00 | 7.03 | 891.50 | 7.20 | 22.36 | 7.39 | 24.82 |
| 8.00 | 1054.00 | 8.14 | 978.70 | 8.34 | 29.84 | 8.52 | 19.44 |
| 9.18 | 992.80 | 9.34 | 921.20 | 9.52 | 28.45 | 10.09 | 21.62 |
| 12.37 | 867.50 | 12.53 | 926.30 | 13.13 | 24.10 | 17.00 | 21.84 |
| 16.07 | 802.50 | 16.27 | 782.30 | 16.42 | 22.75 | 20.37 | 22.23 |
| 19.35 | 756.00 | 19.53 | 742.10 | 20.14 | 59.24 | 24.53 | 23.29 |
| 23.50 | 714.40 | 24.10 | 713.00 | 24.30 | 685.30 | 34.20 | 25.23 |
| 33.12 | 688.50 | 33.39 | 682.60 | 33.59 | 684.30 | 45.28 | 26.12 |
| 44.18 | 670.50 | 44.40 | 667.20 | 45.28 | 666.90 | 65.43 | 44.96 |
| 64.10 | 651.60 | 64.40 | 649.70 | 65.04 | 651.60 | 116.46 | 162.40 |
| 115.20 | 608.30 | 115.45 | 606.20 | 116.20 | 608.00 | | |

TABLE 3

Conductivity Results at Flow Rate 1.6 GPM

| Time (min) | Conductivity (μS) Level 1 | Time (min) | Conductivity (μS) Level 2 | Time (min) | Conductivity (μS) Level 3 | Time (min) | Conductivity (μS) Level 4 |
|---|---|---|---|---|---|---|---|
| 0.12 | 15.88 | 0.24 | 120.80 | 0.43 | 245.30 | 0.56 | 4.38 |
| 1.15 | 136.20 | 1.29 | 139.30 | 1.47 | 141.90 | 2.01 | 104.10 |
| 2.19 | 134.90 | 2.34 | 130.90 | 2.51 | 134.00 | 3.08 | 128.30 |
| 3.27 | 128.40 | 3.46 | 127.40 | 4.03 | 126.10 | 4.22 | 127.60 |
| 4.47 | 125.90 | 5.03 | 126.10 | 5.18 | 126.10 | 5.37 | 126.20 |
| 6.00 | 126.00 | 6.14 | 126.00 | 6.29 | 126.10 | 6.55 | 126.00 |
| 7.24 | 126.90 | 7.36 | 125.80 | 7.52 | 125.90 | 8.10 | 126.00 |

EXAMPLE 3

Slurry Blend Test

Figure 9:
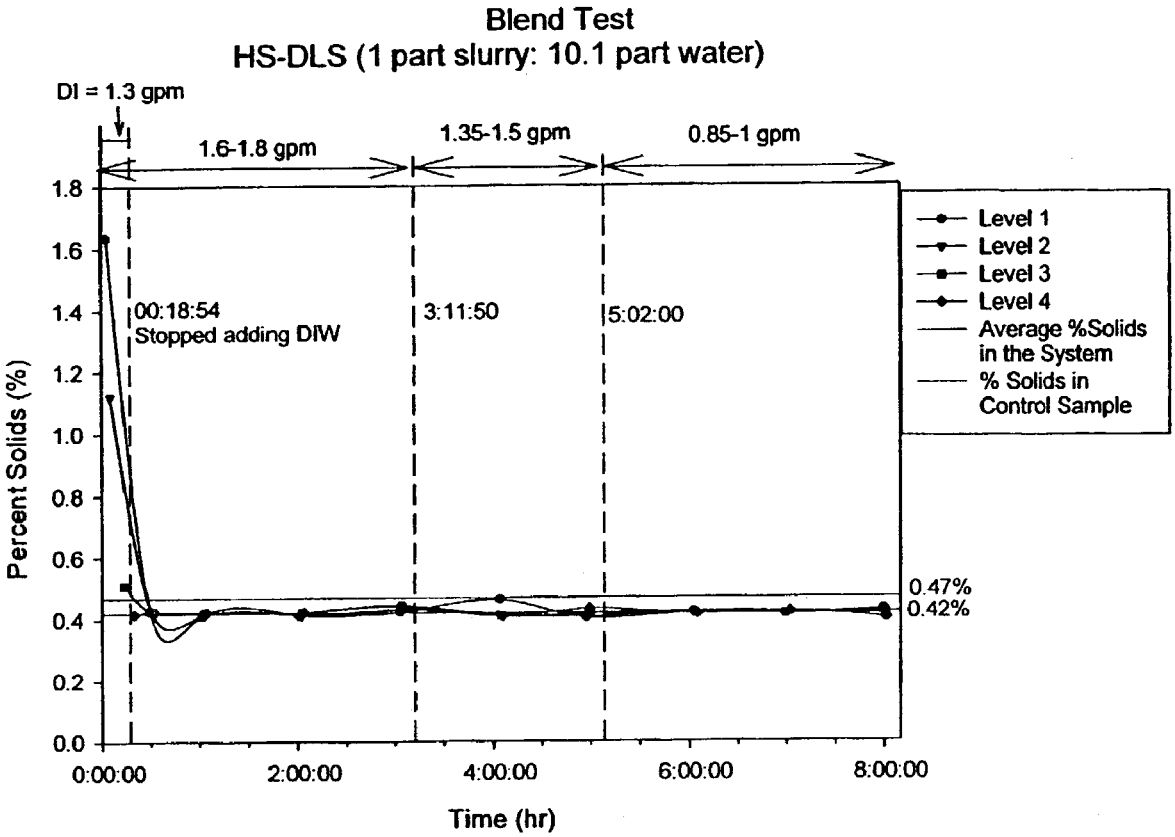
FIG. 9 is a graph showing slurry blend test results.

The tank was tested with a fast settling ceria slurry and samples were analyzed for percent solids. HS-DLS available from Hitachi was used for this experiment. HS-DLS is known to settle very fast. Nine (9) liters of slurry was added to the empty tank followed by 91 liters of DI water. During addition of the water the content of the tank was recirculated at an average flow rate of 1.7 gpm. Samples were taken during the addition of DI water. After reaching level 4 or 99.27 liters of diluted slurry in the tank, the DI water valve was closed and the system continued to recycle at a flow rate of 1.7 gpm. After 3 hours the recirculation flow rate was decreased to an average flow rate of 1.47 gpm and after another 3 hours its was decreased to 0.9 gpm. During the experiment, samples were obtained from 4 levels in the tank as described in Example 2. Percent solids analysis was performed on the samples. The results are tabulated in Table 4 and represented in FIG. 9. From FIG. 9 it is evident that mixing was achieved as soon as the liquid level reached level 4.

Once the ceria particles were suspended at a high flow rate the ceria particles remained in suspension even at lower flow rates. Once the flow patterns similar to FIG. 2 were achieved in the tank then even at lower flow rates the jets will continue to keep the slurry well mixed and the particles in suspension.

TABLE 4

Percent Solid Results of Ceria Slurry

| Recirculation Flow Rate (gpm) | Pressure at Pump (psi) | Time | Percent Solids Level 1 | Time | Percent Solids Level 2 | Time | Percent Solids Level 3 | Time | Percent Solids Level 4 |
|---|---|---|---|---|---|---|---|---|---|
| 1.6–1.8 (while adding DI) | 18 | 0:03:07 | 1.64 | 0:05:24 | 1.12 | 0:14:00 | 0.51 | 0:20:05 | 0.42 |
| 1.6–1.8 (after adding DI) | 20 | 0:29:40 | 0.43 | 0:30:28 | 0.43 | 0:31:17 | 0.42 | 0:32:00 | 0.42 |
| | | 1:01:39 | 0.41 | 1:02:50 | 0.41 | 1:03:00 | 0.42 | 1:04:50 | 0.42 |
| | | 2:01:16 | 0.41 | 2:02:45 | 0.41 | 2:03:00 | 0.42 | 2:04:00 | 0.42 |
| | | 3:03:13 | 0.42 | 3:03:48 | 0.43 | 3:04:00 | 0.44 | 3:05:02 | 0.44 |
| 1.35–1.5 (after adding DI) | 20 | 3:11:50 | | | | | | | |
| | | 4:03:50 | 0.46 | 4:04:25 | 0.42 | 4:05:03 | 0.41 | 4:05:42 | 0.41 |
| | | 4:57:21 | 0.40 | 4:57:57 | 0.41 | 4:58:44 | 0.42 | 4:59:25 | 0.43 |
| 0.85–1 (after adding DI) | 20 | 5:02:00 | | | | | | | |
| | | 6:02:46 | 0.42 | 6:03:22 | 0.42 | 6:04:02 | 0.42 | 6:05:27 | 0.42 |
| | | 6:59:24 | 0.41 | 7:00:11 | 0.42 | 7:00:56 | 0.42 | 7:02:04 | 0.42 |
| | | 7:59:46 | 0.43 | 8:00:00 | 0.41 | 8:00:50 | 0.42 | 8:01:28 | 0.40 |

EXAMPLE 4

Slurry Resuspension Test

If there is a shut down in a semiconductor fabrication plant the slurry in the day tank would settle over time. To simulate such an event, the slurry from Example 3 was left to settle in the tank for more than 24 hours. To resuspend the slurry blend a recirculation flow rate of 0.9 gpm was used.

Figure 10:
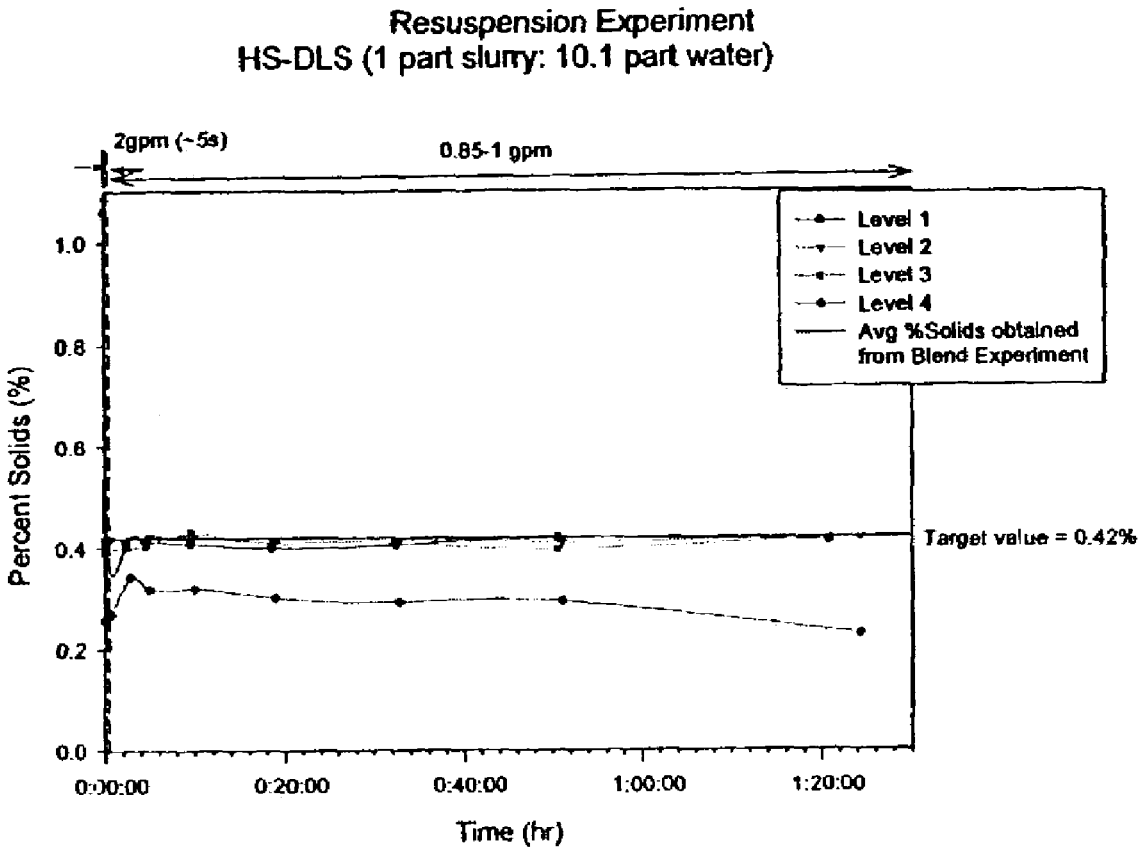
FIG. 10 is a graph showing slurry concentrations as a function of time during a slurry resuspension test.

Samples were taken as soon as the pump started and then periodically during the experiment. The samples were analyzed for percent solids and the results are provided in Table 5 and FIG. 10.

TABLE 5

Percent Solids Results from Ceria Slurry Resuspension Test

| Recirculation Flow Rate (gpm) | Pressure at Pump (psi) | Time | Percent Solids Level 1 | Time | Percent Solids Level 2 | Time | Percent Solids Level 3 | Time | Percent Solids Level 4 |
|---|---|---|---|---|---|---|---|---|---|
| 0.85–1 | 20 | 0:00:00 | 1.06 | 0:00:00 | 0.41 | 0:00:00 | 0.42 | 0:00:00 | 0.26 |
| | | 0:00:11 | 0.39 | 0:00:43 | 0.42 | 0:00:11 | 0.40 | 0:00:43 | 0.27 |
| | | 0:02:23 | 0.41 | 0:02:49 | 0.42 | 0:02:23 | 0.40 | 0:02:49 | 0.34 |
| | | 0:04:35 | 0.41 | 0:04:59 | 0.42 | 0:04:35 | 0.40 | 0:04:59 | 0.32 |
| | | 0:09:32 | 0.41 | 0:10:00 | 0.42 | 0:09:32 | 0.43 | 0:10:00 | 0.32 |
| | | 0:18:37 | 0.40 | 0:19:02 | 0.41 | 0:18:37 | 0.41 | 0:19:02 | 0.30 |
| | | 0:32:21 | 0.40 | 0:32:51 | 0.41 | 0:32:21 | 0.41 | 0:32:51 | 0.29 |
| | | 0:50:36 | 0.42 | 0:51:08 | 0.41 | 0:50:36 | 0.40 | 0:51:08 | 0.29 |
| | | 1:20:48 | 0.41 | 1:24:20 | 0.42 | 1:20:48 | 0.42 | 1:24:20 | 0.23 |

The above examples show that the inventive self-mixing tank can achieve mixing and maintain particle suspension without the use of mechanical mixers. The shape of the tank and the inlet nozzle is able to achieve mixing in a short period. As shown above, mixing was achieved at all levels in the tank in less than a minute when the recirculation rate was 0.9 gpm and density differences between the fluids were insignificant. When density differences impacted mixing, higher flow rates could be used to homogenize the fluids in the tank.

While the foregoing description and drawings represent the preferred embodiments of the present invention, it will be apparent to those skilled in the art that various changes and modifications may be made therein without departing from the true spirit and scope of the present invention.

What is claimed is:

1. A self-mixing tank comprising a tank, the tank comprising:

a top section comprising a front wall, a back wall opposing the front wall, and two mutually opposing side walls, the front back and two side walls defining a rectangular cross-section having a width side-to-side and a width front-to-back such that the front-to-back width is less than the side-to-side width;

a rounded bottom section comprising a single lowest point and at least one curved wall extending from the lowest point to at least one side wall of the top section;

an inlet located inside the tank at the lowest point; and, an outlet located inside the tank above and in close proximity to the inlet.

2. The tank of claim 1 wherein the inlet comprises at least two openings directed at the curved walls.

3. The tank of claim 2 wherein the inlet openings are holes.

4. The tank of claim 2 wherein the inlet openings are slits.

5. The tank of claim 1 wherein the top section has a rectangular front profile.

6. The tank of claim 5 wherein the rectangular profile is a square.

7. The tank of claim 1 wherein the curved wall is a semi-circle.

8. The tank of claim 7 wherein the inlet comprises two sets of opposed openings directed at the curved wall.

9. The tank of claim 1 wherein the curved wall is a quarter-circle.

10. The tank of claim 9 wherein the inlet comprises one set of openings directed at the curved wall.

11. The tank of claim 1 wherein the curved wall is a parabola.

12. The tank of claim 11 wherein the inlet comprises one set of openings directed at the curved wall.

13. The tank of claim 1 wherein the outlet is in contact with the inlet.

14. A self-mixing tank comprising:

a tank comprising an upper section attached to a bottom section, wherein:

(1) the upper section comprises a rectangular front profile having a first width and a rectangular side profile having a second width which is less than the first width;

(2) the bottom section comprises a front profile having at least one rounded portion and a single lowest point, the rounded section comprising at least one concave curve extending between the lowest point and a point of attachment between the upper section and the bottom section wherein the bottom section further comprises at least one side or bottom wall having curvature, the curvature defined by the curve of the rounded section profile, an inlet located inside the tank at the lowest point of the rounded bottom section, the inlet comprising at least two openings directed horizontally towards the curved side or bottom wall, and an outlet located inside the tank above and in close proximity to the inlet.

15. The tank of claim 14 wherein the inlet openings are slits.

16. The tank of claim 14 wherein the inlet openings are multiple holes.

17. The tank of claim 14 wherein the top section has a square profile.

18. The tank of claim 14 wherein the bottom section has a semi-circular front profile.

19. The tank of claim 1 wherein the inlet is connected to the discharge end of a recirculation loop comprising a pump.

20. The tank of claim 1 wherein the outlet is connected to the feed end of the recirculation loop.

21. The tank of claim 1 wherein the first width and the second width are the same.

22. A system for maintaining a fluid in constant motion, the system comprising:

a tank comprising:

a top section comprising a front wall, a back wall opposing the front wall, and two mutually opposing side walls, the front back and two side walls defining a rectangular cross-section having a width side-to-side and a width front-to-back such that the front-to-back width is less than the side-to-side width;

a rounded bottom section comprising a single lowest point and at least one curved wall extending from the lowest point to at least one side wall of the top section;

an inlet located inside the tank at the lowest point;

an outlet located inside the tank above and in close proximity to the inlet;

a pump in fluid communication with the outlet; and a recirculation loop providing fluid communication between the pump and the inlet.

23. A mixing system, the system comprising:

a tank comprising:

a top section comprising a front wall, a back wall opposing the front wall, and two mutually opposing side walls, the front back and two side walls defining a rectangular cross-section having a width side-to-side and a width front-to-back such that the front-to-back width is less than the side-to-side width;

a rounded bottom section comprising a single lowest point and at least one curved wall extending from the lowest point to at least one side wall of the top section;

an inlet located inside the tank at the lowest point;

an outlet located inside the tank above and in close proximity to the inlet;

a pump in fluid communication with the outlet;

a recirculation loop providing fluid communication between the pump and the inlet; and a bypass loop comprising an inlet end in fluid communication with the recirculation; and an outlet end in fluid communication with the recirculation loop wherein the bypass loop is adapted to permit injection of a material to be mixed.

* * * * *